US006029482A

United States Patent [19]

Rifkin

[11] Patent Number: 6,029,482

[45] Date of Patent: Feb. 29, 2000

[54] SECURITY POUCH HAVING A LOCKING MECHANISM ASSOCIATED WITH AN ELECTRONIC MODULE

[75] Inventor: Arnold S. Rifkin, Wilkes-Barre, Pa.

[73] Assignee: A. Rifkin Co., Wilkes-Barre, Pa.

[21] Appl. No.: 08/853,790

[22] Filed: May 9, 1997

[51] Int. Cl.[7] ..... E05B 67/38

[52] U.S. Cl. ..... 70/68; 70/434; 109/43

[58] Field of Search ..... 70/68, 67, 440, 70/434, 432, 433; 292/307 R; 109/38, 39, 43, 44

[56] References Cited

U.S. PATENT DOCUMENTS

| | | | |
|---|---|---|---|
| 3,580,016 | 5/1971 | Kerr | 70/370 |
| 3,759,073 | 9/1973 | Rifkin | 70/68 |
| 4,106,849 | 8/1978 | Stieff | 70/440 |
| 4,447,123 | 5/1984 | Page et al. | 70/440 |
| 4,766,419 | 8/1988 | Haywood | 70/434 |
| 5,013,162 | 5/1991 | Williams et al. | 70/68 |
| 5,065,602 | 11/1991 | Williams et al. | 70/68 |
| 5,594,430 | 1/1997 | Cutter et al. | 70/278 |

*Primary Examiner*—Darnell M. Boucher
*Attorney, Agent, or Firm*—Michael Ebert

[57] ABSTRACT

A security pouch for carrying confidential documents or other valuables from a sending to a remote receiving station, the pouch being adapted to inform its receiver whether at some point in the course of transit, the pouch had been intercepted and opened and then reclosed. The pouch is provided with closure means, a locking mechanism which when locked engages the closure means and secures the documents within the pouch, and an electronic module operatively coupled to this mechanism. The electronic module includes a random number generator, an elapsed time measuring unit and an LCD display to present the number and the elapsed time. When at the sending station, the sender locks the pouch containing the documents, this action triggers the generator to produce and display a random number. And it also resets the elapsed time unit which then proceeds to count time. Normally, when the pouch arrives at the receiving station, the module then displays the same random number, thereby assuring the receiver that the pouch had not been intercepted in the course of transit. But if at some point in this course, the pouch was intercepted and unlocked to obtain access to the documents and then relocked, then when the pouch arrives at the receiving station, the random number then displayed does not match that produced at the sending station. And the elapsed time then displayed indicates the time that had elapsed from the time of interception, not from the sending time.

2 Claims, 5 Drawing Sheets

SECURITY POUCH HAVING A LOCKING MECHANISM ASSOCIATED WITH AN ELECTRONIC MODULE

BACKGROUND OF INVENTION

1. Field of Invention

This invention relates generally to pouches for safely carrying classified documents or other confidential or valuable material from a sending to a remote receiving station, and more particularly to a security pouch adapted to inform its receiver whether at some point in the course of transit, the pouch had been intercepted and invaded.

2. Status of Prior Art

As used herein, the term "pouch" is applicable to any hand-carried bag, briefcase or container adapted to accommodate documents or other classified material, or to accommodate other valuable articles, such as bank notes or jewelry. The term "sending station," as used herein, refers to the site at which the documents are put in a closable pouch and then locked, while the term "receiving station" as used herein, refers to a site remote from the sending site at which the pouch is unlocked to obtain access to these documents.

It is common practice for federal agencies dealing with classified material, such as the FBI and CIA, to use couriers to hand-carry confidential documents from a sending station to a remote receiving station. The reason these documents are hand-carried is to avoid interception by unauthorized personnel, for one cannot rely on conventional means, such as ordinary mail or Federal Express to safely convey these documents. For like reasons, embassies and consulates make use of diplomatic pouches which are hand carried by couriers.

It is known to provide a security pouch with a key-operated locking mechanism so that documents contained in the pouch cannot be removed without unlocking the pouch. At a sending station, the locked pouch is given to a courier to be taken to a remote receiving station. When the courier arrives at the receiving station, a receiver, using a key matching that used by the sender, then unlocks the pouch to remove the documents.

The problem with relying on matching keys to ensure security is that security in this situation depends on the absence of a third key in the hands of an unauthorized individual. But if this individual has in some way succeeded in obtaining a copy of the key and is able to intercept the pouch at some point in its transit from the sending to the receiving station, he can open the pouch, remove and make copies of the documents or otherwise tamper with them, before returning the documents to the pouch and relocking the pouch.

Yet when the relocked pouch arrives at the receiving station, the receiver has no way of knowing that the pouch had been intercepted in the course of transit if it still contains documents. And if the pouch contains no documents or contains substituted documents, the receiver has no way of knowing when and where in the course of transit the original documents were removed.

Inasmuch as a security pouch in accordance with the invention includes a locking mechanism operatively coupled to an electronic module provided with a random number generator which is activated when the lock is closed, of prior art interest is the electronic seal for document bags being marketed by Encrypta Electronics Limited. Also of prior art interest is the 1995 Hayward U.S. Pat. No. 5,447,344 assigned to Encrypta.

The Encrypta electronic seal takes the form of an electronic module which cooperates with a beaded cord similar to a chain of interlinked beads. One end of this cord is attached to the module, the free end going into a door catch in the module to form a loop. The module is provided with a random number generator and an elapsed time indicator, as well as an LCD display for the random number and the elapsed time reading.

When the Encrypta cord is caught in the door catch in the module to complete the seal, this action causes the display in the module to present a random number. This number is unpredictable, for each time the cord is caught, a new number is generated unrelated to the previous number. When the sealed bag is later delivered, the display then presents the same number as well as the time that had elapsed (days; hours; minutes) from the point in time at which the bag was sealed to the point in time at which the bag was received.

But if the random number presented at the receiving station differs from that presented at the sending station, this is evidence that the seal had been broken and then reclosed before the bag arrived at the receiving station.

A seal in the form of a cord loop is not a locking mechanism, for it serves only to deny access to a closure of some sort. Thus if a document bag is provided with a zipper associated with a locking mechanism that holds the zipper closed, and overlying the zipper locking mechanism is a flap which must be folded out to obtain access to the locking mechanism, a cord seal which loops through the flap prevents the flap from being folded out. Hence only by breaking the seal does one gain access to the locking mechanism.

The concern of the Encrypta electronic seal unit is with the integrity of the seal, not with the operation of a locking mechanism. In a security pouch in accordance with the invention, an electronic module provided with a random number generator and an elapsed time measuring unit is operatively coupled to a locking mechanism associated with the closure means of the pouch.

Since in one embodiment of the invention, the pouch has a zipper whose slider is engaged by the jaws of a locking mechanism, of prior art interest is the Rifkin U.S. Pat. No. 5,065,602.

SUMMARY OF INVENTION

In view of the foregoing, the main object of this invention is to provide a security pouch for confidential documents having closure means engaged by a locking mechanism operatively coupled to an electronic module having a random number generator and a display therefor whereby when the mechanism is locked to prevent the closure means from being opened, a random number is then displayed, and when the pouch is thereafter received, the same number is displayed.

A significant feature of a security pouch in accordance with the invention is that if in the course of transit from a sending station at which the locking mechanism is locked to a remote receiving station, the pouch is intercepted before it arrives at the receiving station and there unlocked to obtain access to the documents and then relocked, when the pouch arrives at the receiving station, the random number then displayed will differ from that presented at the sending station, thereby informing the receiver that the pouch had been intercepted.

More particularly, an object of this invention is to provide a security pouch of the above type in which the electronic module operatively coupled to the locking mechanism includes not only a random number generator but also an elapsed time measuring unit which acts to indicate the time which had elapsed from the time at which the mechanism was locked or relocked to the time at which it was later received. If therefore the mechanism was locked, unlocked and relocked, then at the receiving station the unit will only indicate the time that elapsed from the time it was relocked.

For example, we shall assume that it normally takes say 10 hours, 30 minutes for the pouch to be carried by a courier from a sending station along a known route to a remote receiving station. Hence when the bag arrives at this station, the display will then show an elapsed time of 10 hours 30 minutes or a time close thereto. But if the bag is intercepted at some point along the route, and there unlocked and relocked, when the bag arrives at the receiving station, should the elapsed time then displayed be 5 hours and 10 minutes, this is indicative of the time at which the interception took place, from which time one may deduct where it took place. In any case, if the elapsed time displayed at the receiving station deviates to a significant degree from the expected elapsed time, there is then good reason to suspect that the bag had been intercepted.

Yet another object of this invention is to provide a self-sufficient unitary assembly constituted by a locking mechanism and an electronic module operatively coupled thereto.

Briefly stated, these objects are attained by a security pouch for carrying confidential documents from a sending to a remote receiving station, the pouch being adapted to inform its receiver whether at some point in the course of transit, the pouch had been intercepted and opened and then reclosed.

The pouch is provided with closure means, a locking mechanism which when locked engages the closure means and secures the documents within the pouch, and an electronic module operatively coupled to this mechanism. The electronic module includes a random number generator, an elapsed time measurement unit and an LCD display to present the number and the elapsed time. When at the sending station the sender locks the pouch containing the documents, this action triggers the generator to produce and display a random number. And this action also resets the elapsed time unit which then proceeds to count the time.

Normally, when the pouch arrives at the receiving station, the module then displays the same random number, thereby assuring the receiver that the pouch had not been intercepted in the course of transit. But if at some point in this course, the pouch was intercepted and unlocked to obtain access to the documents and then relocked, when the pouch arrives at the receiving station, the random number then displayed does not match that produced at the sending station. And the elapsed time then displayed indicates the time that had elapsed from the time of interception, not from the sending time.

BRIEF DESCRIPTION OF DRAWING

For a better understanding of the invention as well as other objects and further features thereof, reference is made to the following detailed description to be read in conjunction with the accompanying drawings, wherein.

DESCRIPTION OF INVENTION

Figure 1:
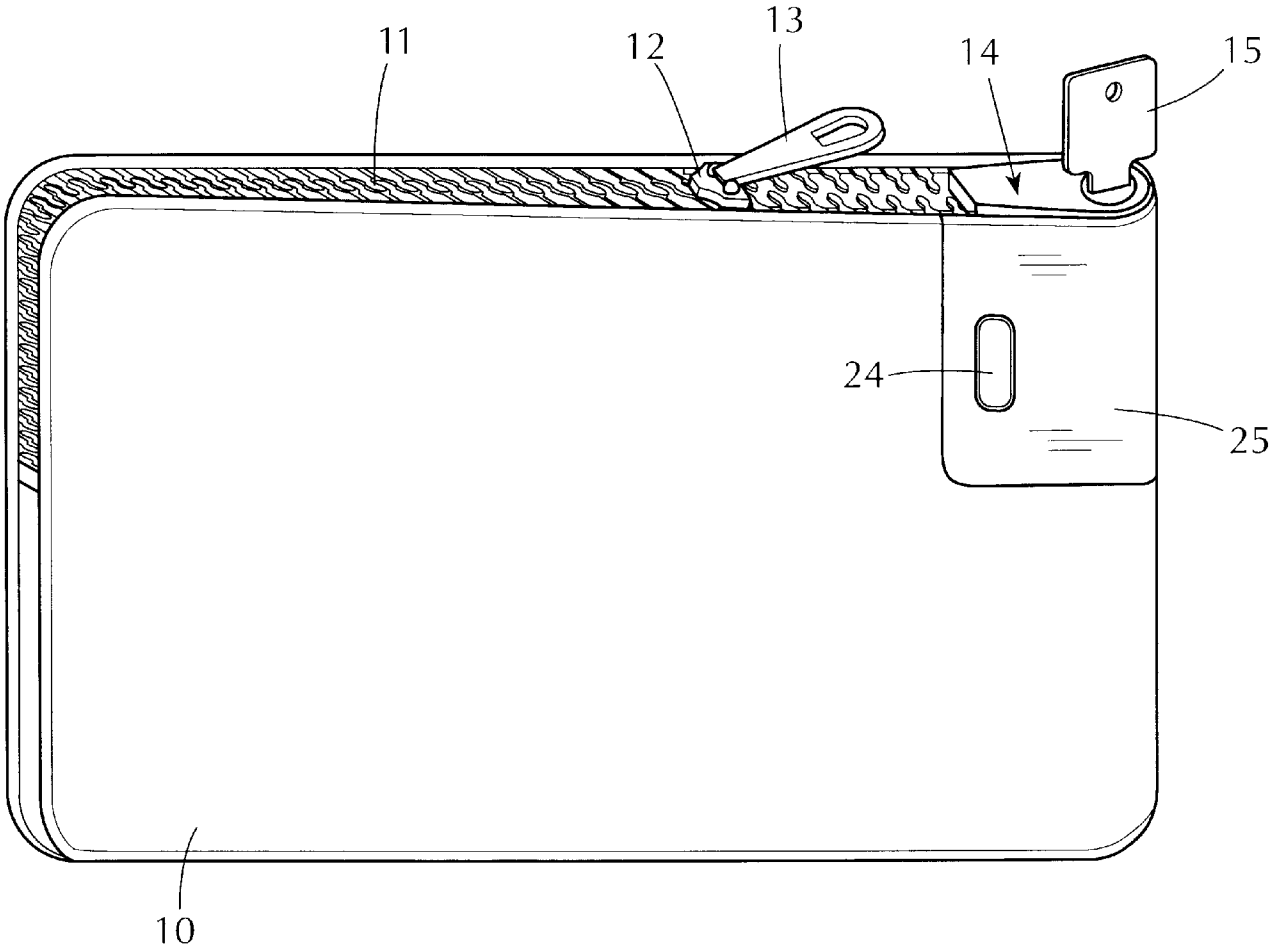
FIG. 1 is a perspective view of a security pouch in accordance with the invention.
Figure 2:
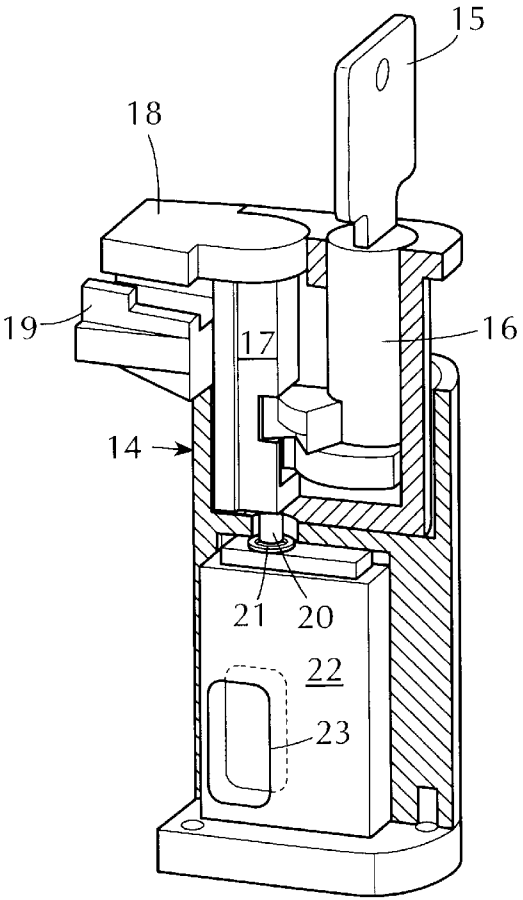
FIG. 2 is a separate view of an integrated assembly of a key-operated locking mechanism and an electronic module operatively coupled thereto.

Referring now to FIGS. 1 and 2, shown therein is a security pouch 10 in accordance with the invention. The pouch is fabricated of high-strength fabric or plastic sheeting. Access to the pouch is had by way of a conventional metal-teeth slide fastener or zipper 11 which extends along the upper edge of the pouch. The zipper is provided with a slider 12 and a finger tab 13 coupled thereto for pulling the slider to open or close the zipper. The dimensions of the pouch are such as to accommodate confidential documents or other classified material.

Mounted within pouch 10 at its upper right corner adjacent one end of the zipper is an assembly 14 housed in a rectangular metal case. As shown separately in FIG. 2, assembly 14 includes a locking mechanism operated by a key 15 inserted in a barrel 16 which cooperates with a spring-biased plunger 17. Plunger 17 is associated with a pair of locking jaws consisting of an upper jaw 18 attached to the top of plunger 17 adapted to engage a fixed lower jaw 19 when the plunger is depressed.

The locking jaw is adapted to capture slider 12 of the zipper when the zipper is closed. Hence when documents are contained in the security pouch, and the zipper is closed and locked, the documents are secured and cannot then be removed.

Figure 5:
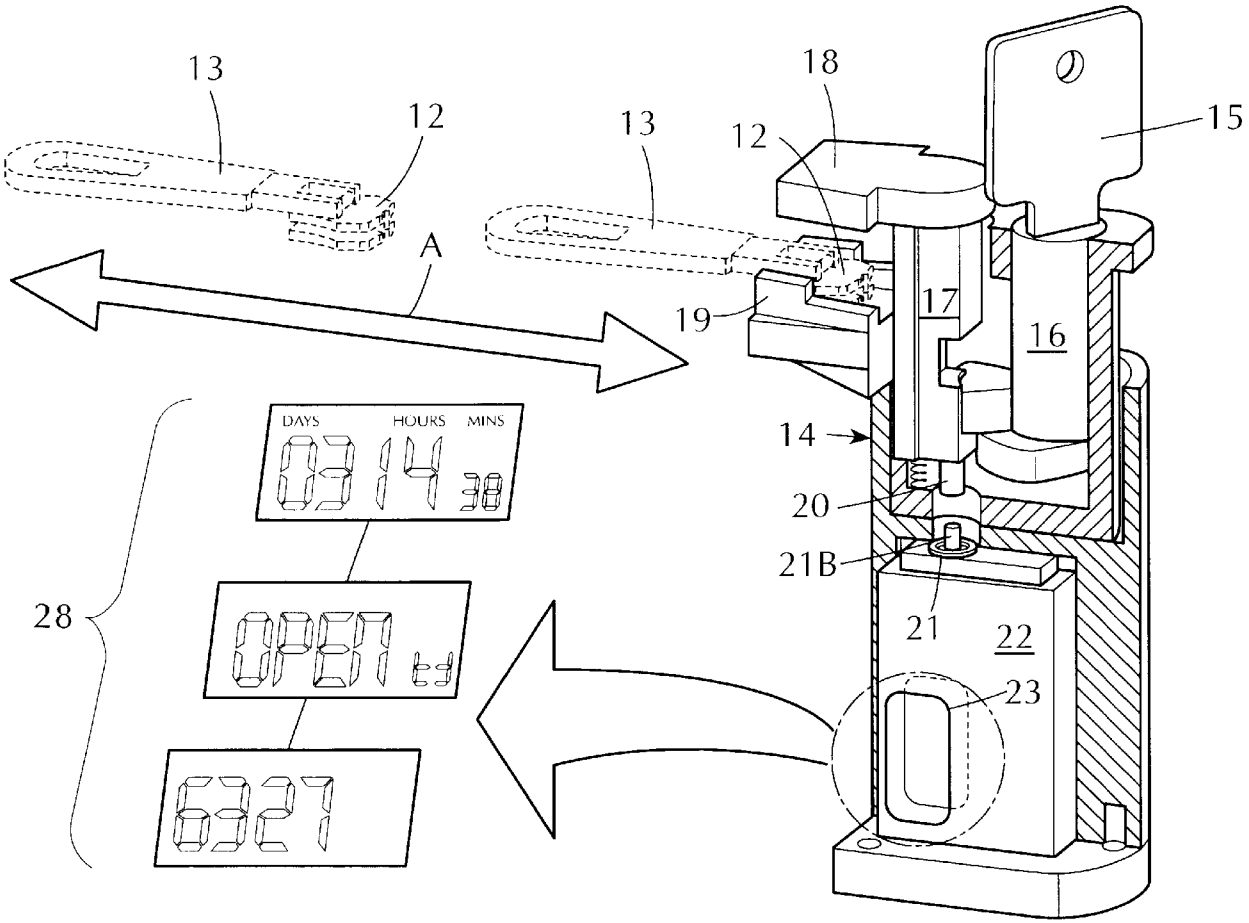
FIG. 5 is the same as FIG. 4, except that the mechanism has been unlocked by a key.

Plunger 17 is provided at its lower end with a projecting pin 20. When plunger 17 is depressed by a user pushing upper jaw 18 down to engage lower jaw 19, pin 20 then engages and actuates a microswitch 21. As shown in FIG. 5 in which plunger 17 is in its raised position, microswitch 21 includes an actuator button 21B, and it is this button that is engaged by plunger pin 20 to close the switch.

Microswitch 21 is positioned at the upper end of an electronic module 22 nested within the metal case of assembly 14 below the locking mechanism. Module 22 includes an LCD display which is exposed through a rectangular opening 23 in the front wall of the case. When assembly 14 is mounted within the pouch as shown in FIG. 1, then module opening 23 which exposes the LCD display, lies in registration with a transparent plastic window 24 formed in a reinforcing patch 25. This patch is made of leather or flexible plastic material which is attached to the pouch and embraces its upper right corner. Hence assembly 14 installed in the pouch is protectively shielded by patch 25.

Operation

Figure 3:
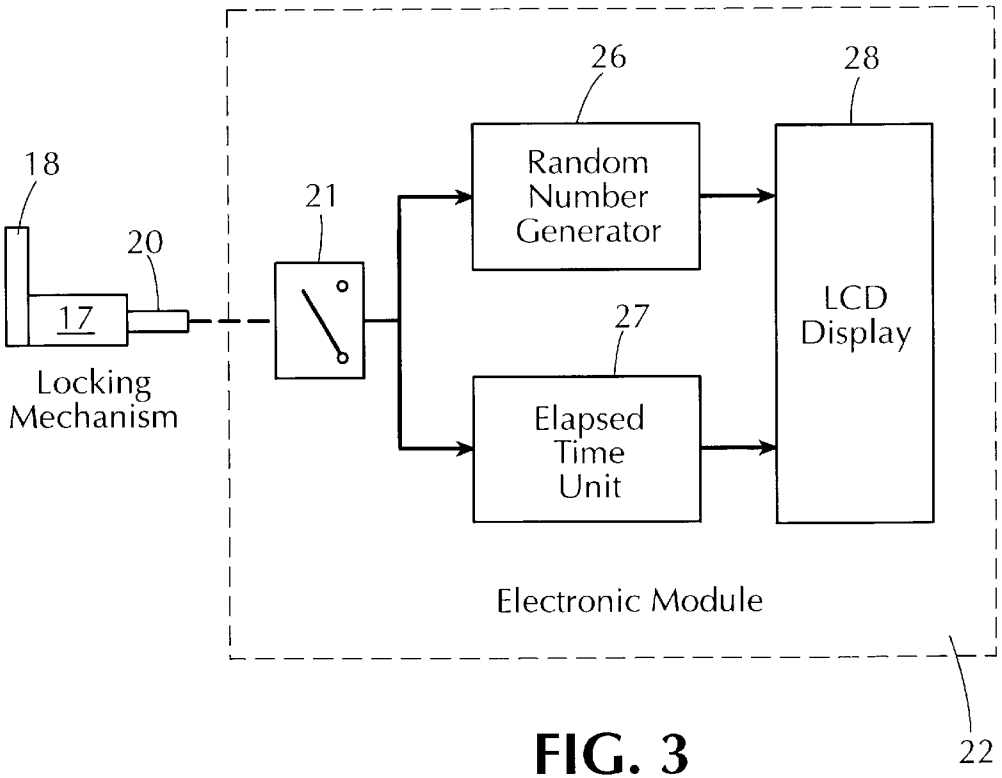
FIG. 3 is a block diagram illustrating the components of the assembly and the manner in which they cooperate.

The operative relationship between the locking mechanism which includes plunger 17 from which pin 20 projects, and the electronic module 22 is schematically shown in FIG. 3.

When upper jaw 18 at the upper end of plunger 17 is depressed to close the locking jaws, pin 20 then actuates microswitch 21 of electronic module 22. The module is powered by a lithium cell or other long life battery (not shown).

Switch 21 is coupled to a random number generator 26 and also to an elapsed time measuring unit 27 which when activated is reset and proceeds to count the time that elapses from the time of actuation in terms of days, hours and minutes. Typically, it takes several days for a courier to deliver a security pouch, hence in this period in which the courier is traveling there is a risk of interception.

Random number generator 26 which may be of the type used in computer technology in which a set of computer instructions act to scramble an integer by mixing and combining its digits. Thus if the integer is constituted by four whole numbers, the possible permutation run from 0000 to 9999. Whatever random number is produced by generator 26 is not predictable. If therefore when switch 21 is closed, generator 26 then yields number 1043, when the switch is again closed, it will yield another number, say as 4964. The likelihood that the same number will appear is highly improbable.

Each time switch 21 is closed or opened, this action resets the elapsed time measuring unit 27 to zero time, and the unit then proceeds to count time. If therefore the elapsed time unit 27 is reset at a sending station when the locking mechanism of the pouch is closed, and 8 hours later the pouch is intercepted and the locking mechanism is opened and then reclosed, and the reclosed pouch arrives at the receiving station two hours later, then at the receiving station the elapsed time unit will read 2 hours, not 10 hours.

Associated with random number generator 26 and elapsed time unit 27 is an LCD display 28 which presents whatever number is yielded by the generator as well as the elapsed time reading of the unit. The LCD display may also be arranged to indicate that the locking mechanism is open, for when the locking mechanism is closed, then module switch 21 is closed, and when the mechanism is open, the switch is then open. The display therefore is responsive to the open state of the switch to read OPEN.

Stage One

Figure 4:
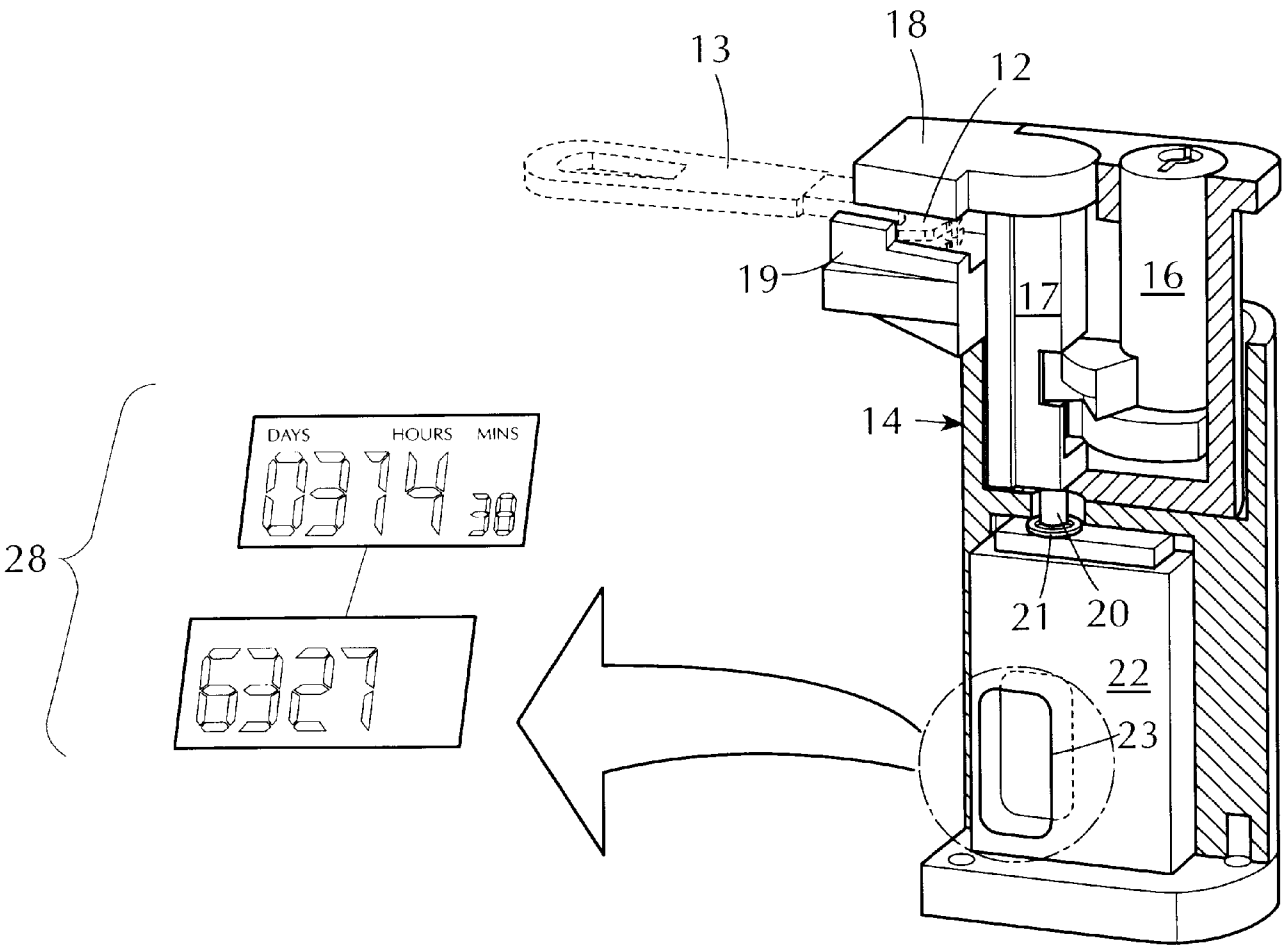
FIG. 4 is a section taken through the assembly showing the locking mechanism in its locked state and the resultant LCD display produced by the electronic module.

FIG. 4 illustrates the relationship of the zipper of the pouch, when in a closed state, to the locking mechanism of assembly 14. It will be seen in this figure that slider 12 of the zipper is then clamped between closed jaws 18–19 of the locking mechanism, the finger tab 13 hinged to slider 12 being outside the jaws. When the slider of the zipper is clamped within the locking mechanism, the zipper cannot be opened, and contents of the pouch are secure. While for purposes of illustration, the specification describes these contents as being confidential documents, in practice the contents may be valuables of any sort that are unsafe to send by means other than the security pouch.

When the jaws are closed, plunger 17 of the locking mechanism is then in its depressed position, with its pin 20 actuating microswitch 21 of the electronic module 22.

We shall assume that at a sending station, confidential documents are placed in the pouch, the zipper of the pouch is then closed, and the zipper locked by the locking mechanism, at which point a random number is generated and displayed on LCD display 28.

FIG. 4 shows on LCD display 28 the random number 6327, this number having been presented at the instant the pouch was locked. At that same instant, the elapsed time unit was reset and proceeded to count. What is shown therefore in FIG. 4 is the elapsed time reading taken 3 days, 10 hours and 38 minutes later. Hence the reading is 03-10-38.

In practice, LCD display 28 may be arranged so as to present only one reading at a time, so that the readings alternate between a random number and an elapsed time reading.

Stage Two

FIG. 5 shows key 15 inserted in barrel 16 of the locking mechanism to turn the barrel and thereby release the spring-biased plunger 17 so that it is raised up to unlock jaws 18 and 19. As indicated by the double pointed arrow A slider 12 of the zipper may now be taken from the jaws by the receiver of the locked pouch so that the pouch may be unzipped and the documents removed therefrom.

When the locking mechanism is unlocked by key 15, as shown in FIG. 5, plunger pin 20 is disengaged from spring-biased button 21B of microswitch 21 of electronic module 22, and the switch is then open. This state is indicated on LCD display 28 by OPEN. But when the switch is opened at the receiving station, the number then presented on display 28 is the same as the number generated at the sending station when the switch was closed in response to the locking action of the locking mechanism. It is important to note that it is only when the locking mechanism is locked that this action triggers the random number counter and resets the elapsed time unit. Unlocking the mechanism does not alter the random number but it does reset the elapsed time unit, and causes the term OPEN to flash alternately with the random number.

And the elapsed time, whenever indicated, is the time that elapsed from the time at which the pouch was locked at the sending station to the time the pouch was received at the receiving station, unless at some point in the course of transit, the pouch was unlocked and relocked, in which case the elapsed time runs from the relocking action. It is important to note that the elapsed time indicated is the time the locking mechanism was either locked or unlocked. Hence at the receiving station one should read the elapsed time before the locking mechanism is opened, for when it is opened, the elapsed time unit is reset to zero time.

Stage Three

Figure 6:
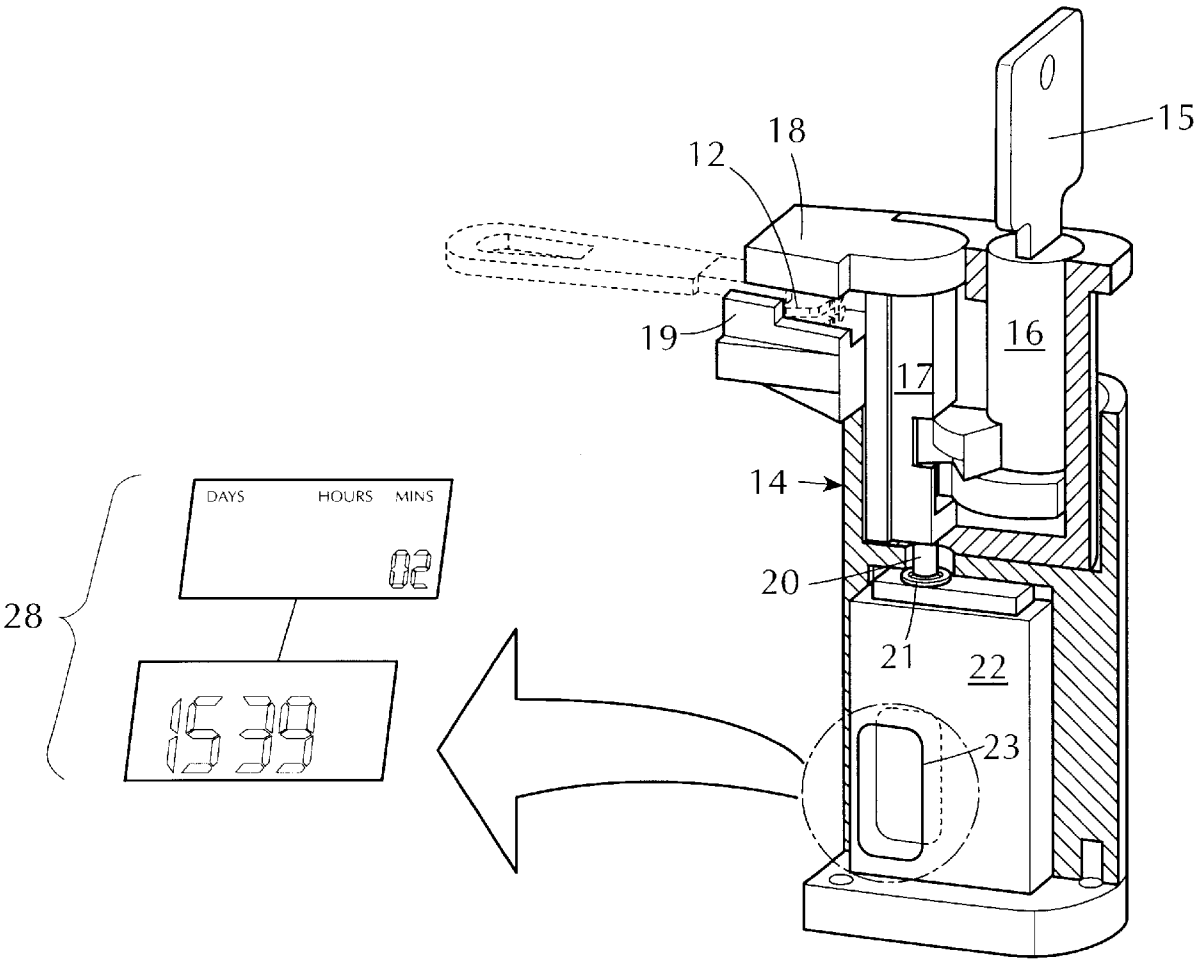
FIG. 6 is the same as FIG. 5 except that the mechanism has been relocked by applied downward pressure on the upper jaw of the locking mechanism.

Referring now to FIG. 6, it will be seen that jaw 18 which is raised in FIG. 5, is again depressed to relock the pouch. Hence slider 12 of the zipper is again clamped between the jaws. Key 15 can now be removed from barrel 16.

This relocking action again actuates switch 21, as a consequence of which a new random number is presented. Thus LCD display 28 now shows number 1539 which is quite different from number 6327 previously presented. And the elapsed time measuring unit is reset, so that the display no longer shows 03-10-30 as in FIG. 5, but now shows 2 minutes, this reading occurring two minutes after the instant of relocking. Hence whenever the mechanism is locked or relocked, this action results in a new random number and resets the lapsed time unit which then proceeds to count time.

Interception

We shall now consider how a receiver of the lockable pouch at the receiving station remote from the sending station is put on notice of an intervention in the course of its transit.

When the pouch containing classified documents is locked by the sender at the sending station, this action causes a random number to be generated and displayed. It also causes the elapsed time unit to be reset and to proceed to count the time.

If the locked pouch is carried from the sending station to the receiving station and is not intercepted in the course of transit, then the receiver is presented with the same random number that was generated at the sending station. This assures the receiver that the pouch had not been intercepted. It is, of course, important for the sender to communicate to the receiver the random number of the pouch. And the receiver is presented with an elapsed time reading which informs him how long it took for the pouch to go from the sending to the receiving station.

If however, when the receiver is presented with a random number that differs from that produced at the time the pouch was locked at the sending station, this informs him that this new number could only have been produced as a result of the pouch having been intercepted in the course of transit and then unlocked and relocked, the relocking action giving rise to a new random number.

And the receiver, knowing the time it normally takes along a known route for the pouch to travel from the sending station to the receiving station, is then informed from the elapsed time reading which is shorter than the normal time, when the intervention occurred and roughly where along this route.

Hence a security pouch in accordance with the invention does more than just informs its user, such as a federal intelligence agency, that a pouch containing classified material was invaded by an unauthorized individual in the course of its travel to the receiving station. By giving the time at which the intervention occurred, the user is given a clue helping him to track down the intruder.

The invention is not limited to a pouch having a closable zipper, nor to a key-operated locking mechanism adopted to clamp onto the slider of the zipper. But whatever closure means is included in the pouch, and however the locking mechanism is operated, it must be capable, when locked, of engaging the closure means to prevent opening of the pouch until the mechanism is unlocked.

While there has been shown a preferred embodiment of a security pouch having a locking mechanism associated with an electronic module in accordance with the invention, it is to be understood that many changes may be made therein without departing from the spirit of the invention.

What is claimed is:

1. A security pouch for carrying confidential documents from a sending to a receiving station, the pouch being adapted to inform its receiver whether at some point in the course of its travel, the pouch had been intercepted and opened and then reclosed, said security pouch comprising:

(A.) a pouch having closure means which, when opened admits said documents, and when closed seals the documents in the pouch;

(B.) a locking mechanism installed in the pouch adapted to engage the closed closure means so that it cannot be opened; and (C.) an electronic module operatively coupled to the locking mechanism and including a random number generator and a display therefor which is activated each time the mechanism is locked whereby when at the sending station the pouch containing said documents is locked, a random number is then presented, and when the pouch is received at the receiving station, and the same number is presented, this assures the receiver that the pouch had not been opened, but if the number is different, this informs the receiver that the pouch had been opened, the locking mechanism and the module operatively coupled thereto being combined in a case to form a unitary assembly that is mounted at an upper corner of the pouch, said module being provided with an LCD display which is viewable through an opening in the case, said pouch in the corner thereof in which the assembly is mounted having a window in registration with the opening exposing the display.

2. A pouch as set forth in claim 1, in which the pouch is formed of high-strength fabric and is provided with a patch to reinforce said upper corner.

* * * * *